US005143241A

United States Patent [19]

Szymanski

[11] Patent Number: 5,143,241

[45] Date of Patent: Sep. 1, 1992

[54] CAN SEAL

[76] Inventor: John M. Szymanski, 4115 Monroe St., Omaha, Nebr. 68107

[21] Appl. No.: 704,790

[22] Filed: May 23, 1991

[51] Int. Cl.[5] ..... B65D 17/34

[52] U.S. Cl. ..... 220/270

[58] Field of Search ..... 220/270; 215/254

[56] References Cited

U.S. PATENT DOCUMENTS 2,967,000 1/1961 Burns ..... 220/270

3,347,407 10/1967 Coolidge, Jr. et al. ..... 220/270 X 4,350,261 9/1982 Roth ..... 220/270

*Primary Examiner*—Stephen Marcus

*Assistant Examiner*—Nova Stucker

[57] ABSTRACT

An improved can seal is provided for a beverage can having a generally cylindrical body with a closed bottom end and an open top end, a top closure. The can seal consists of the open top end of the body that has an outwardly curled edge thereabout. The top closure has an outwardly hemmed edge formed over the outwardly curled edge of the body, to form a sealing rim on the exterior of the body. All of the liquid contents within the body can be extracted therefrom without any obstruction from the sealing rim.

1 Claim, 1 Drawing Sheet

CAN SEAL

BACKGROUND OF THE INVENTION

The instant invention relates generally to beverage containers and more specifically it relates to a improved can seal which provides a sealing rim with pull tab on the exterior of the can.

There are available various conventional containers which do not provide the novel improvements of the invention herein disclosed.

SUMMARY OF THE INVENTION

A primary object of the present invention is to provide an improved can seal that will overcome the shortcomings of the prior art devices.

Another object is to provide an improved can seal in which a sealing rim is on the exterior of the can so that all of the contents of the can will be extracted without any obstruction.

An additional object is to provide an improved can seal that includes a pull tab formed in one side of the top closure and into the sealing rim on the exterior of the can so that when the pull tab is broken and removed therefrom the contents will be poured through the opening in the top enclosure of the can without any obstruction.

A further object is to provide an improved can seal that is simple and easy to use.

A still further object is to provide an improved can seal that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
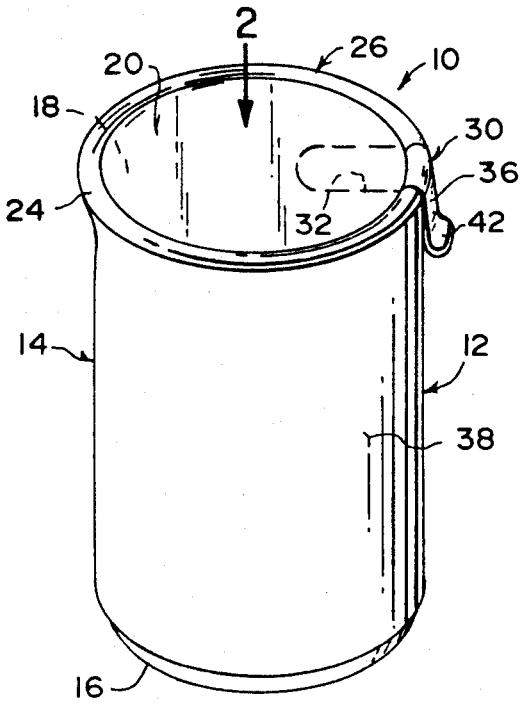
FIG. 1 is a perspective view showing a complete can in accordance with the instant invention.
Figure 3:
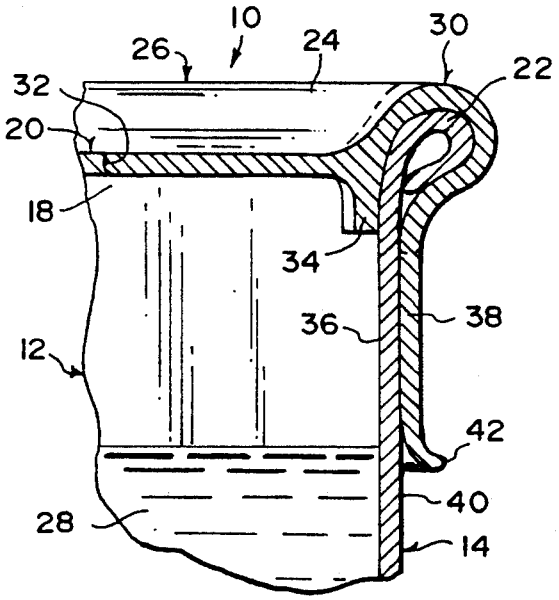
FIG. 3 is an enlarged cross sectional view taken along line 3—3 in FIG. 2 showing the pull tab in greater detail.
Figure 2:
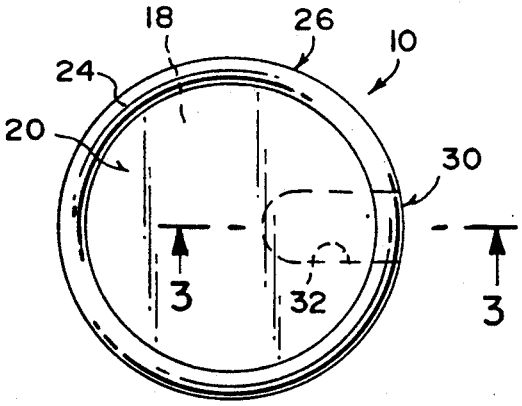
FIG. 2 is a top view taken in direction of arrow 2.

Turning now descriptively to the drawings, in which similar reference characters denote similar elements throughout the several views, the Figures illustrate an improved can seal 10 for a beverage can 12, having a generally cylindrical body 14 with a closed bottom end 16 and an open top end 18, and a top closure 20. The can seal 10 consists of the open top end 18 of the body 14 having an outwardly curled edge 22 thereabout. The top closure 20 has an outwardly hemmed edge 24 formed over the outwardly curled edge 22 of the body 14, to form a sealing rim 26 on the exterior of the body

14. All of the liquid contents 28 within the body 14 can be extracted therefrom without any obstruction from the sealing rim 26.

The improved can seal 10 further includes a pull tab 30 formed in one side of the top closure 20 and into a portion of the outwardly hemmed edge 24. When the pull tab 30 is broken and removed therefrom, all of the liquid contents 28 can be poured through the opening 32 in the top closure 20 and passed the curled edge 22 of the body 14.

The pull tab 30 further includes a downwardly extending finger 34 against the interior surface 36 of the body 14 opposite the curled edge 22 to prevent accidental leakage of the liquid contents 28 before the pull tab 30 is removed therefrom. The pull tab also includes a downwardly extending elongated band 38 against the exterior surface 40 of the body 14. The band 38 has a curved distal end 42 so that the elongated band 38 can be pulled up to release the pull tab 30 from the top closure 20.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An improved can seal in combination with a beverage can have a generally cylindrical body and interior surface with a closed bottom end, a cylindrical open top end, a top closure said can seal comprising:

a) the open top end of the body having an outwardly curled edge which smoothly extends from said interior surface b) the top closure having an outwardly hemmed edge formed snuggling and completely over said outwardly curled edge of the body, to form a sealing rim on said curled edge and body, and to form a sealing rim on said curled edge and interior surface so that all of the liquid contents within the body can be extracted therefrom without any obstruction from said sealing rim; further including a pull tab formed in one side of the top closure and into a portion of said outwardly hemmed edge so that when said pull tab is broken and removed therefrom, all of the liquid contents can be poured through the opening in the top closure and smoothly past said curled edge of the body, wherein said pull tab further includes a downwardly extending finger having a sealing surface mating smoothly with said curled edge and said interior surface of said body to prevent leakage of the liquid contents before said pull tab is removed therefrom; wherein said pull tab further includes a downwardly extending elongated band which fits continuously against the exterior surface of the body, said band having a curved distal end so that said elongated band can be conveniently grasped and pulled up to released said pull tab from the top closure; exposing an unobstructed smooth pouring opening.

* * * * *